United States Patent [19]

Holmes et al.

[11] 4,418,009

[45] Nov. 29, 1983

[54] ELECTRICAL RESISTOR AND METHOD OF MAKING THE SAME

[75] Inventors: Curtis L. Holmes, Elkhart, Ind.; William M. Faber, Sr., Plano, Tex.; Gaylord L. Francis, Morristown, N.J.; Otis F. Boykin, Chicago, Ill.

[73] Assignee: CTS Corporation, Elkhart, Ind.

[21] Appl. No.: 506,449

[22] Filed: Oct. 24, 1965

Related U.S. Application Data

[63] Continuation of Ser. No. 169,355, Jan. 29, 1962, abandoned.

[51] Int. Cl.[2] ..... H01B 1/02

[52] U.S. Cl. ..... 252/514; 252/518

[58] Field of Search ..... 252/514, 518; 106/39, 106/53, 55, 63; 264/61

[56] References Cited

U.S. PATENT DOCUMENTS

| | | | |
|---|---|---|---|
| 2,718,577 | 9/1955 | Sherk | 264/61 |
| 2,786,819 | 3/1957 | Smith et al. | 252/514 X |
| 2,924,540 | 2/1960 | D'Andrea | 252/514 X |
| 2,950,996 | 8/1960 | Place et al. | 252/514 X |
| 3,154,503 | 10/1964 | Janakirama-Rao et al. | 252/514 X |

*Primary Examiner*—John D. Welsh

*Attorney, Agent, or Firm*—John A. Young

[57] ABSTRACT

Disclosed is a method for making glass bonded metal oxide electric resistors involving including in the mixture a refractory oxide for providing configuration stability during firing.

3 Claims, 12 Drawing Figures

ELECTRICAL RESISTOR AND METHOD OF MAKING THE SAME

The present invention is a continuation of application Ser. No. 169,355, filed Jan. 29, 1962 now abandoned. This invention relates to a composition which is formed into a desired shape and fired to produce a non-porous self-supporting electrical resistor, resistors prepared therefrom, and the method of making the same.

The microminiature component system becoming more and more popular today requires that components, e.g., resistors, capacitors and diodes used in the system to be similarly shaped and of exactly the same length. For example, a popular system at present uses a perforated mounting board or substrate with a thickness of 0.030 inches. The components are mounted in holes in the substrate with their ends flush with the ends of the holes so that they can be electrically interconnected by conductive paths on the surface of the substrate. The length of the components is thus determined by the thickness of the substrate. This limit in the length of the components also limits the diameter thereof, particularly the resistors, since the length to diameter ratio of a resistor has a large effect on the total resistance of the component. These small components are difficult to handle and to assemble. One assembly system requires the component to be packaged by the manufacturer in a hole in a card of specified dimensions. The hole is located with respect to two adjoining sides of the card so that the component can be assembled in the substrate by locating the card with respect to the substrate and then punching the component from the card into a correspondingly located hole in the substrate. This system of assembly requires that the components have a certain minimum amount of structural strength.

At the present time the types of resistors available for this system are the carbon composition type, the metal oxide film type, the metal glass film type, and the deposited carbon film type. The carbon composition type is made by placing a mixture of conductive carbon particles and a thermosetting resin in a mold. Heat and pressure are then applied causing the resin to cure and bind the carbon particles into a rigid mass, which when removed from the mold is self-supporting. This process produces a resistor of relatively low structural strength which also has a very serious temperature limitation since the thermosetting resin can only be used in environments of relatively low ambient temperatures. The last three types all comprise conductive films deposited on ceramic rods. The metal oxide film type comprises a ceramic rod with a film of metal oxide deposited thereon. The oxide most commonly used is tin oxide and, generally, a compound containing tin is sprayed on a heated ceramic rod which decomposes and oxidizes to form tin oxide upon application of heat. The deposited carbon film type is made by placing a ceramic rod in a retort having an atmosphere of hydrocarbon gas. By cracking the gas the rod is coated with a film of carbon. With both this film and the metal oxide film, the desired resistance is obtained by spiralling the coating deposited on the surface of the ceramic rod. Even with spiralling, however, the total resistance available with these types is limited. The metal glass film type employs a resistance film comprising glass admixed with gold, silver, platinum, paladium, rhodium and iridium dispersed therein. The film is usually deposited on one end of a ceramic rod and is terminated by providing a conductive strip down the side of the rod to connect one end of the resistance film with the opposite end of the rod.

The major disadvantage of all of these film type resistors is that they do not lend themselves to mass production techniques. The carbon composition type resistor is, of course, easily adapted to mass production techniques; however, it has the limitations described above. The film type resistor has very good electrical properties with the metal glass type being preferable for most applications. It would be desirable, therefore, if the metal-glass concept could be employed for preparing an electrical resistor capable of being manufactured by mass production techniques. To apply the metal-glass concept to mass production techniques, it is necessary to provide some means for maintaining the glass in the desired shape when it is heated to the firing temperature where it becomes highly fluid. Once this problem is solved, the metal glass type resistor can be produced not only as a film supported by a non-conducting ceramic base, but as a self-supporting resistor having three dimensions, i.e., a fixed volumetric resistor, (the film type resistors being considered two dimensional in that their resistivity is expressed in terms of "ohms per square" thus ignoring their thickness).

It is, therefore, a principal object of the present invention to provide a self-supporting electrical resistor containing glass with one of the noble metals dispersed therein. A further object of the present invention is to provide means for maintaining the glass of a metal glass self-supporting resistor in its preformed shape while firing the glass at a temperature sufficient to make it highly fluid. An additional object of the present invention is to provide a method of manufacturing a metal glass self-supporting electrical resistor containing glass which readily lends itself to mass production techniques. It is also an important object of this invention to provide a method of manufacturing a self-supporting electrical resistor containing glass which does not employ a mold to hold glass in the desired configuration during the firing operation when the glass is in a highly fluid state. Further objects and advantages of the present invention will become apparent as the following description proceeds, and the features of novelty characterizing the invention will be pointed out with particularity in the claims annexed to and forming a part of this specification.

The electrical resistor of the present invention comprises a glass, crystals of one or more of the noble metals and their oxides, and a refractory material having a softening point above that of the glass. The ingredients are combined so that the metal provides a conductive path having the requisite resistivity. The glass holds the metal in position and insulates the metal crystals from the surrounding atmosphere so that no oxidation can occur after the glass becomes rigid. The refractory material provides structural strength to the resistor both during and after firing.

In a preferred form of the invention, the resistor is produced by mixing a finely divided glass with a pyrolytically reducible compound containing the desired metal or metals. To this mixture is added a finely ground refractory material, i.e., refractory particles, having a softening temperature above that of the glass. The mixture is then calcined by heating it to a temperature sufficient to decompose the metallic compound but which is below the temperature required to soften the glass while constantly stirring the mixture to ensure a uniform distribution of the metal. The mixture is then formed into the desired shape and fired at a temperature sufficient to fuse the glass but below that required to soften the refractory material.

All of the noble metals, i.e., gold, silver, platinum, paladium, rhodium, iridium, osmium and ruthenium, can be used in the practice of this invention; however, it has been found that iridium and ruthenium offer some advantages over the other noble metals. These two metals more readily oxidize which allows the resistivity of the product to be adjusted to some extent by controlling the firing time. Also certain combinations of noble metals and/or the oxides thereof are preferable to reproduce consistently certain resistivities with satisfactory electrical characteristics. An additional feature of this invention is the discovery that the composition of the refractory material and the glass used in the invention have a considerable effect on the electrical characteristics of the end product.

The invention will be explained in detail in connection with the attached drawings in which.

Figure 1:
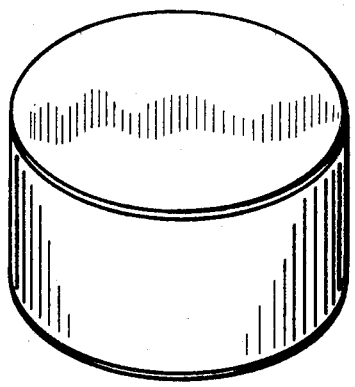
FIG. 1 is an isometric view of a self-supporting electrical resistor made in accord with the present invention enlarged about forty times.
Figure 2:
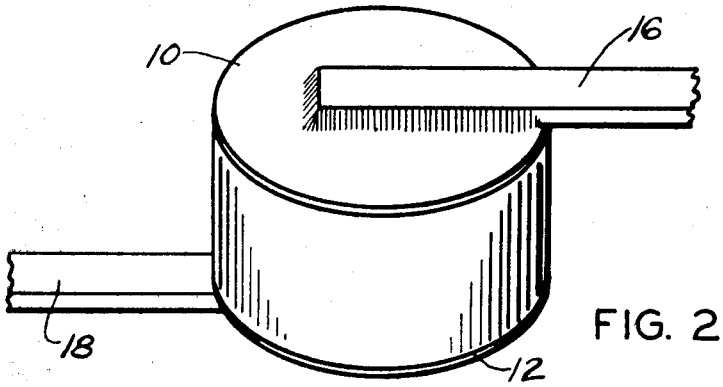
FIG. 2 is an isometric view of the resistor of FIG. 1 with leads attached.

The curves shown in FIGS. 5, 6, 7, 8, and 9 were all obtained from samples fired for the same length of time through a tunnel kiln with a maximum temperature of about 800° C. The samples were then terminated with a conductive paste fused to the resistor by an additional firing at 800° C. for ten minutes.

In order to produce a self-supporting resistor containing glass where it is necessary to fire the resistor at a temperature where the glass becomes highly fluid, some means must be devised to hold the glass in the desired shape during the firing operation. This can be done, of course, by firing the glass-containing composition in a mold. Such a system, however, would not lend itself readily to mass production techniques and the cost would be prohibitively high. It has been found that the highly liquid glass can be held in position without a mold by adding a refractory material to the composition before it is fired. The refractory material is ground extremely fine and added to the composition in an amount sufficient to be from about 30 percent to about 70 percent by weight of the total material used. The resistor is then fired. The glass softens and becomes highly fluid. It flows, however, within a porous structure formed by the refractory material. The pores provided by the refractory material act as capillaries and hold the highly fluid glass in place to maintain the originally formed shape of the resistor. In fact, the refractory material holds the glass in place so well that there is practically no change in the dimensions of the resistor when it is fired.

The number and size of the interstices provided by the refractory material are dependent upon the particle size and percentage of refractory material in the composition. These, in turn, determine how much glass can be held by capillary action. If too much glass is used, the resistor will not hold its molded shape when fired, and usually the excess glass, not being contained, will bond the resistor to its support. If too little glass is used, the resulting resistor will be porous and besides being physically weak, will have an overall resistance subject to change due to moisture absorption in high humidity environments. All refractory materials will hold the glass in position as desired; however, it was found that the choice of refractory material has an effect on the electrical characteristics of the resistor. This is illustrated in the following table where the results obtained with several common refractory materials are set out. Nothing was changed in these tests except the ratio of glass to refractory material, which is dependent on the physical and chemical characteristics of the refractory material and the viscosity of the glass at the firing temperatures. This ratio was determined experimentally. The metal used was ruthenium and the glass was a bismuth-lead borosilicate.

See the following page for table.

| Refractory Material | Ratio Glass/Refractory | Resistivity ohm-cm | Voltage Coefficient ppm/volt | Temperature Coefficient −63° C. to +25° C. ppm/°C. | Temperature Coefficient +25° C. to +125° C. ppm/°C. |
|---|---|---|---|---|---|
| Alumina | 6/8.5 | 32 | −175 | −60 | +67 |
| Beryllia | 6/4 | 91 | −350 | −75 | +13.4 |
| Chromic Oxide | 6/8 | 210 | −9300 | −600 | −865 |
| Feldspar | 6/12 | 135 | −100 | +470 | +510 |
| Kaolin | 6/5 | above $10 \times 10^6$ | — | — | — |
| Silica | 6/6 | 33 | 0 | +245 | +310 |
| Titania | 6/8 | above $10 \times 10^6$ | — | — | — |
| Zinc Oxide | 6/11 | 54K | −6540 | — | −5380 |
| Zirconia | 6/13 | 10.4 | −675 | +860 | +875 |

As readily seen from the table the electrical properties of the resistors varied greatly depending on the refractory material used. Kaolin and titania, for example, produced resistors with exceptionally high resistivities, whereas chromic oxide and zinc oxide produced resistors with large voltage coefficients. In choosing the glass to be used with the refractory material, the prime consideration is its softening or melting temperature relative to that of the refractory material. It is necessary in the practice of the invention that the glass have a softening or melting temperature below that of the refractory material. Being a glass throughout this process, it is always in the liquid state, so it doesn't actually melt at the firing temperature, but it must become sufficiently fluid that upon cooling it will fuse and bond the refractory material and the metal into a rigid, nonporous mass with a high structural strength and it must do so at a temperature which will not soften the refractory material.

Although any glass which meets the temperature requirements can be used, certain compounds have been found to effect the electrical properties of the resistor. For example, bismuth trioxide when added to the glass lowers the resistivity of the product and causes its temperature coefficient to be more positive. The silica content of the glass affects the voltage coefficient, i.e., the higher the percentage of silica the higher the voltage coefficient. The lead oxide content apparently has no effect; however, boric oxide tends to lower the resistivity of the product. A bismuth-lead borosilicate glass has been found to be the most satisfactory when using silica or alumina as the refractory material. This glass is prepared from the following ingredients in approximately the percentages shown:

| | |
|---|---|
| Boric Oxide | 12.6% |
| Bismuth Trioxide | 10.8% |
| Litharge | 66.6% |
| Flint | 10.0% |
| | 100.0% |

The glass is added to the composition as a powder ground fine enough to pass through a 325 mesh screen. To prepare the glass, the glass forming ingredients are melted, reacted, and poured into cold water in the conventional manner. The frit thus formed is ground in a ball mill to the desired fineness. While all of the noble metals can be used certain ones have been found to have advantages over the others in particular resistivity ranges. In addition, it has been found that by combining manganese with ruthenium, unusually low resistivities can be obtained consistently. Other noble metals will produce equivalent resistivities but they are highly unpredictable making them unsuitable for mass production techniques where the resistivity of the end product must be fairly consistent. In combination with the preferred glass described above and either silica or alumina as the refractory material, the following metals have been found to be preferable for the resistivity ranges indicated.

| Resistivity, ohm-cm | Metals |
|---|---|
| 4–50 | Ruthenium and Manganese |
| 50–660 | Ruthenium and Platinum |
| 660–2000 | Ruthenium |
| 2000–16,000 | Iridium and Platinum |

Figure 5:
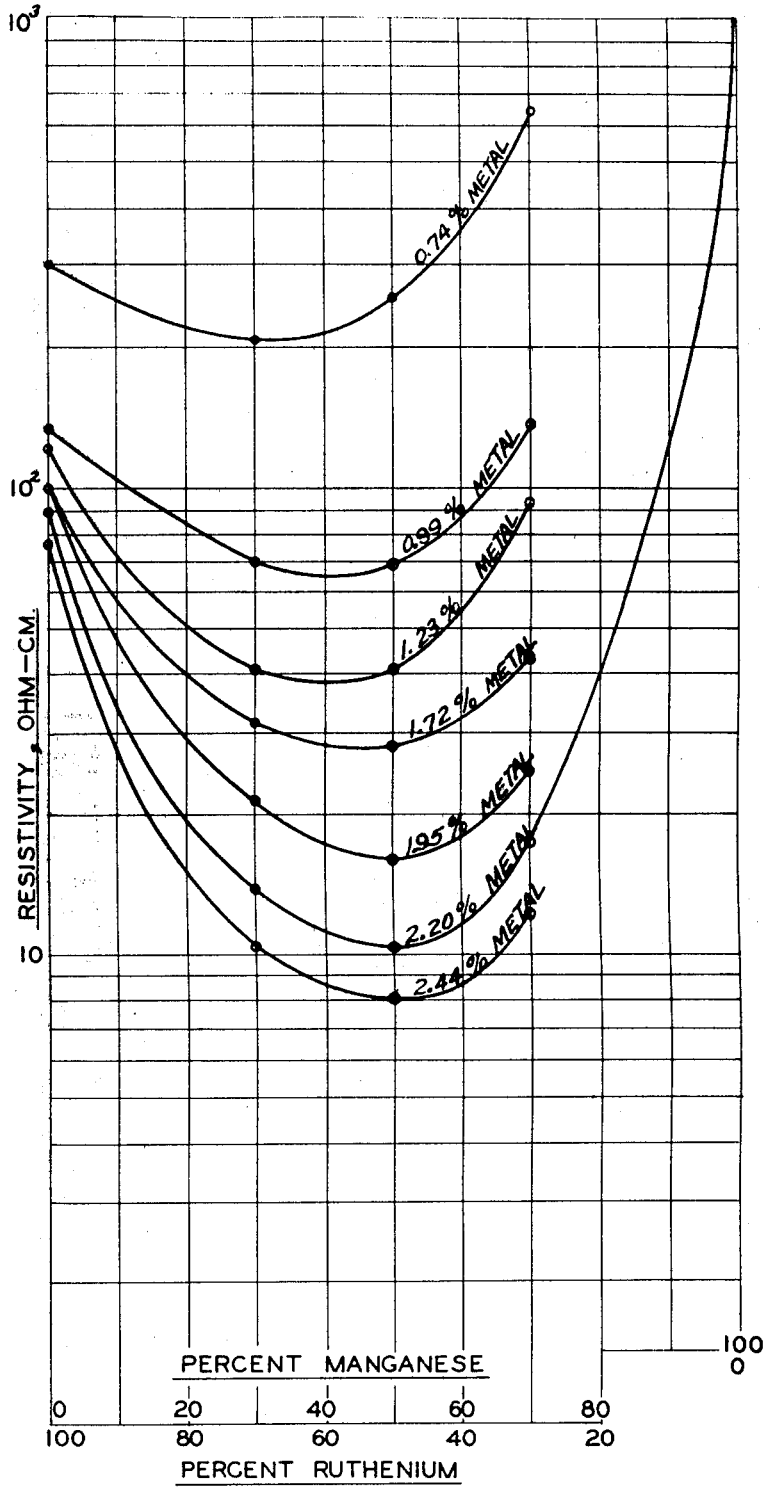
FIG. 5 is a graph illustrating how resistivity varies when manganese is combined with ruthenium for various percentages of total metal.

FIG. 5 illustrates how resistivity is affected by the substitution of manganese for some of the ruthenium in a resistive composition containing ruthenium. As shown, the resistivity decreases as the percentage of manganese is increased until it reaches a minimum determined by the amount of total metal in the composition, after which it begins to increase. Manganese has a resistivity considerably higher than ruthenium and, when it is substituted for a portion of the ruthenium, the resistivity of the composition should increase rather than decrease. It is thought that this unexpected reduction in resistivity by the addition of manganese results from the mutual solubility of the oxides of the metals. The crystals of the two metals are dissimilar to the extent that it would be very unlikely that one would be dissolved in the other. Their oxides, however, have very similar crystalline structures and should be mutually soluble. It is known that both metals oxidize to some extent during the firing process so it is quite possible that the crystals of manganese dioxide and the crystals of ruthenium oxide which result from the firing process form a solid solution. Since the unit cell of manganese dioxide is smaller than the ruthenium oxide unit cell, a reduction in the unit cell of the ruthenium oxide crystals will result with a subsequent increase in their conductivity thus causing a decrease in the resistivity of the resistor.

Figure 6:
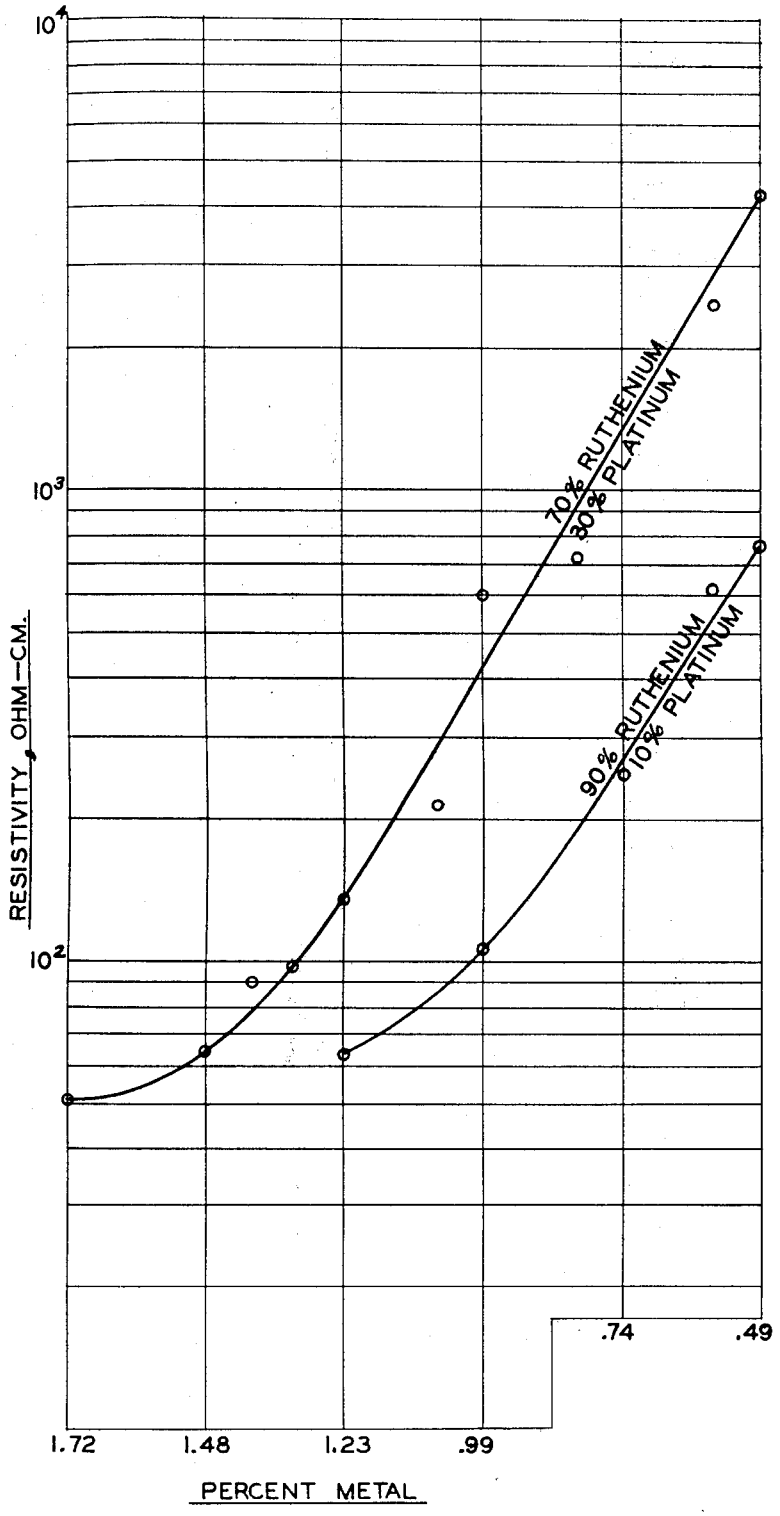
FIG. 6 illustrates how resistivity varies with changes in total metal content for two combinations of ruthenium and platinum.
Figure 7:
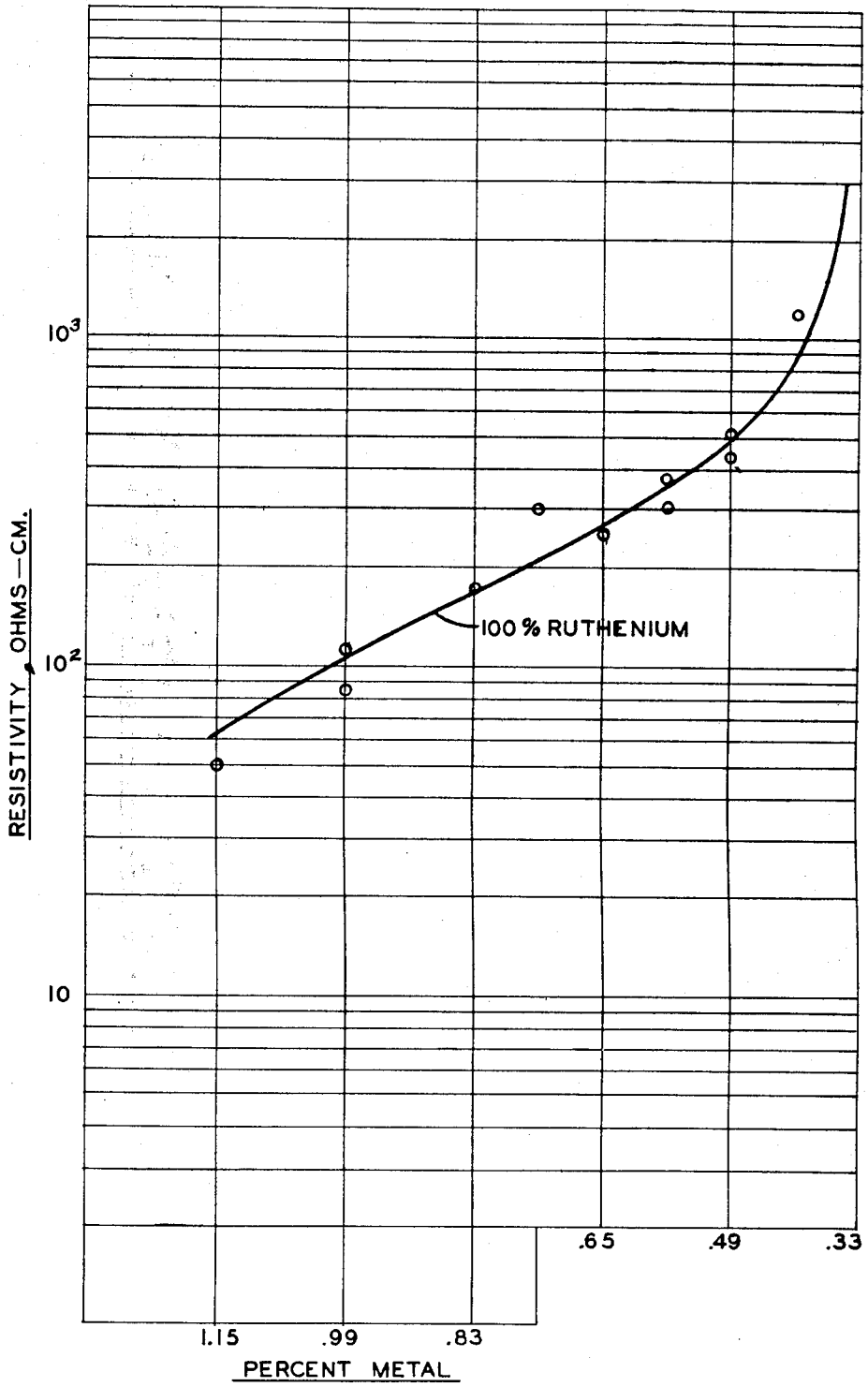
FIG. 7 illustrates how resistivity varies with percent of metal for ruthenium alone.
Figure 8:
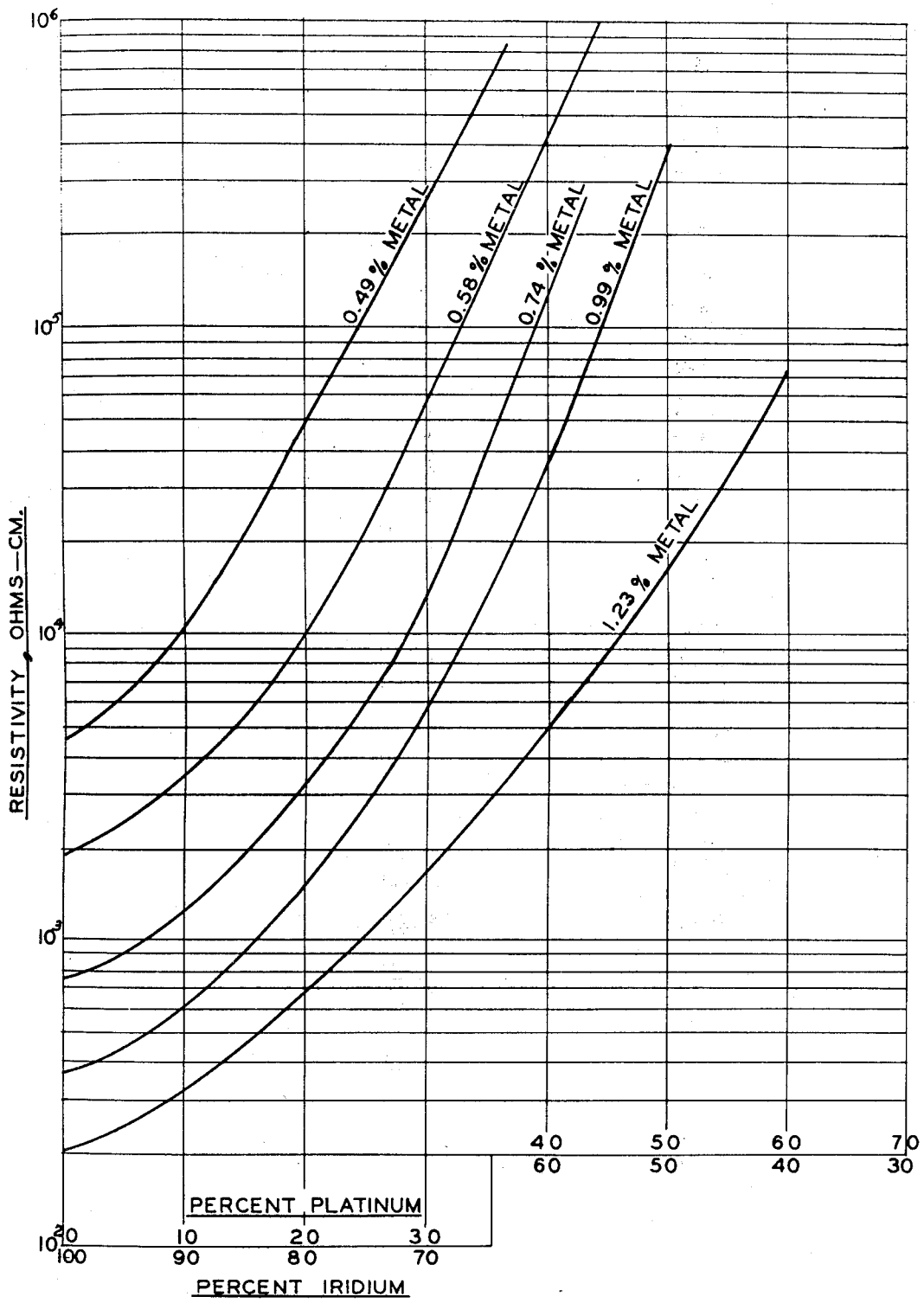
FIG. 8 shows the variation in resistivity with changes in the percentage of platinum alloyed with iridium for various percentages of total metal.
Figure 9:
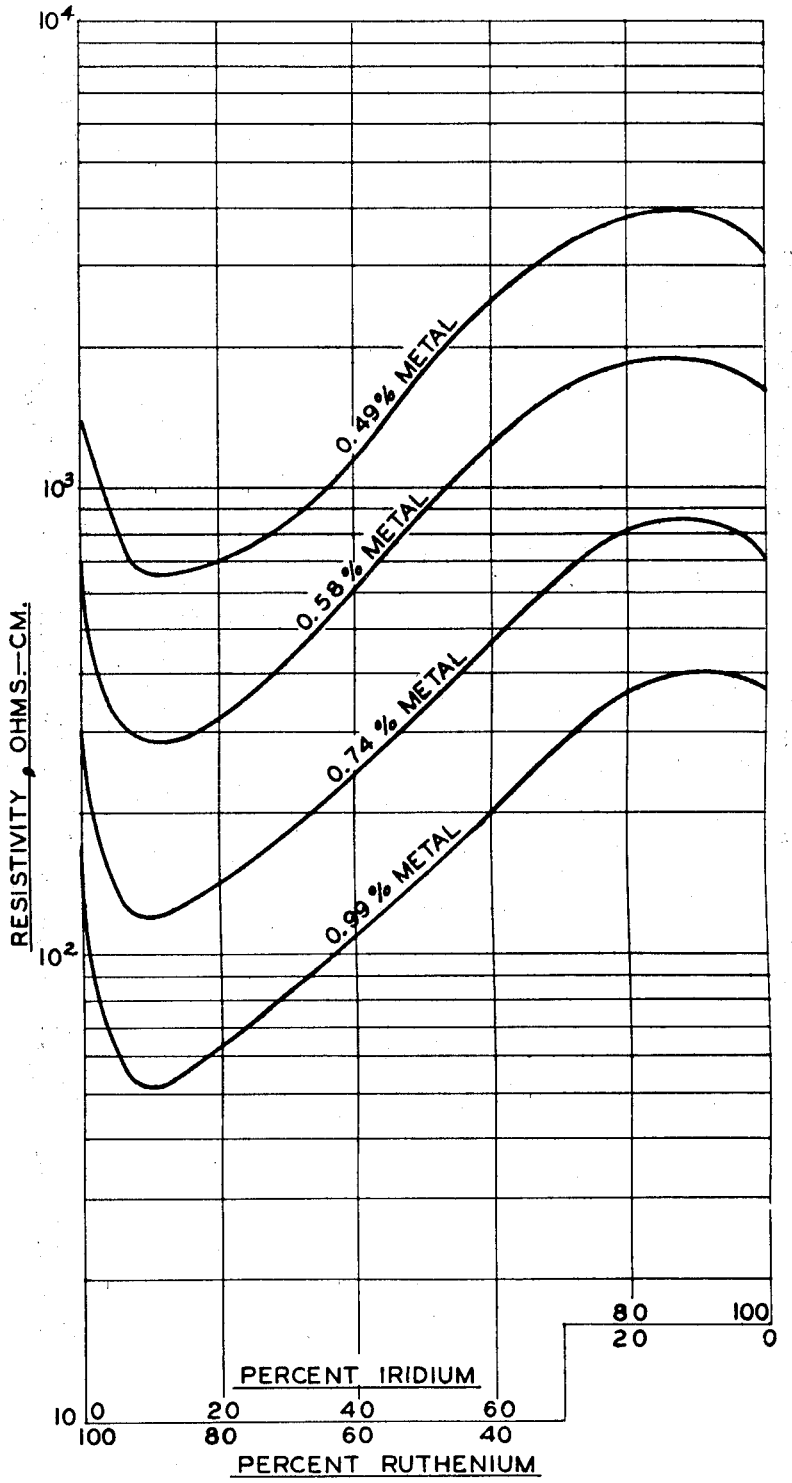
FIG. 9 illustrates how resistivity varies when ruthenium and iridium are combined in different percentages for various percentages of total metal.

In the resistivity range of from 50 to 660 ohm-cm, a combination of ruthenium and platinum is used to obtain the necessary reproducibility. FIG. 6 illustrates how resistivity varies with changes in the total metal content for a composition containing 70 percent ruthenium and 30 percent platinum and one containing 90 percent ruthenium and 10 percent platinum. For resistivities above 660 ohm-cm to around 2000 ohm-cm, ruthenium alone produces the most reproducible resistances having good electrical properties. A graph of percentage of ruthenium v. resistivity is shown in FIG. 7. Obviously ruthenium could be used to obtain a wide range of resistivities, however, the electrical properties are undesirable except in this one range. In the resistivity range of 2000–16,500 ohm-cm an alloy of iridium and platinum, ranging from 10 percent to 50 percent platinum depending on the resistivity desired, produces the best electrical characteristics. This is shown in FIG. 8 where resistivity is plotted against the percentage of iridium used. Several curves are shown, each being for a different percentage of total metal. By changing the total metal and percentages of platinum and iridium the desired resistivity is obtained.

Figure 10:
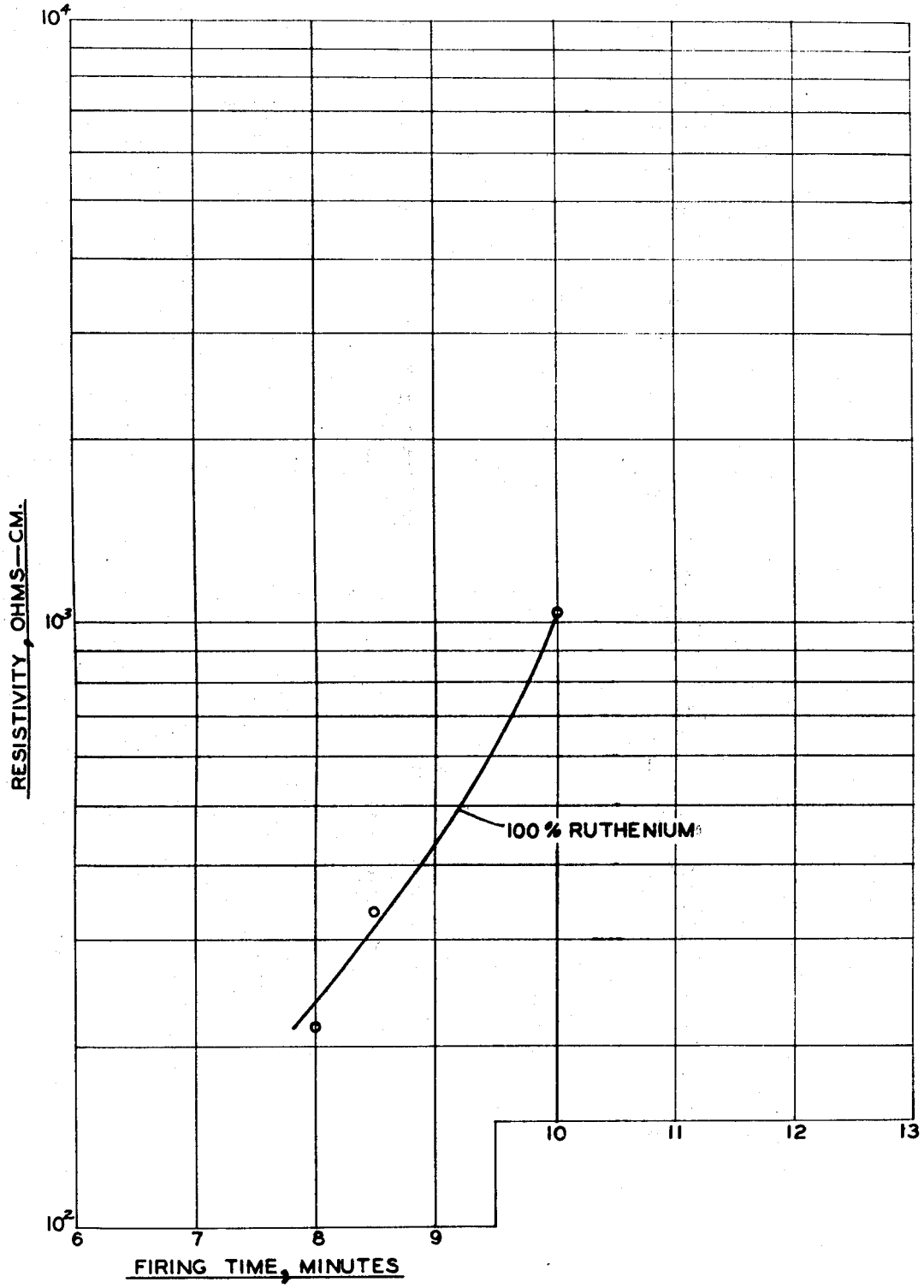
FIG. 10 illustrates how resistivity varies with firing time.
Figure 11:
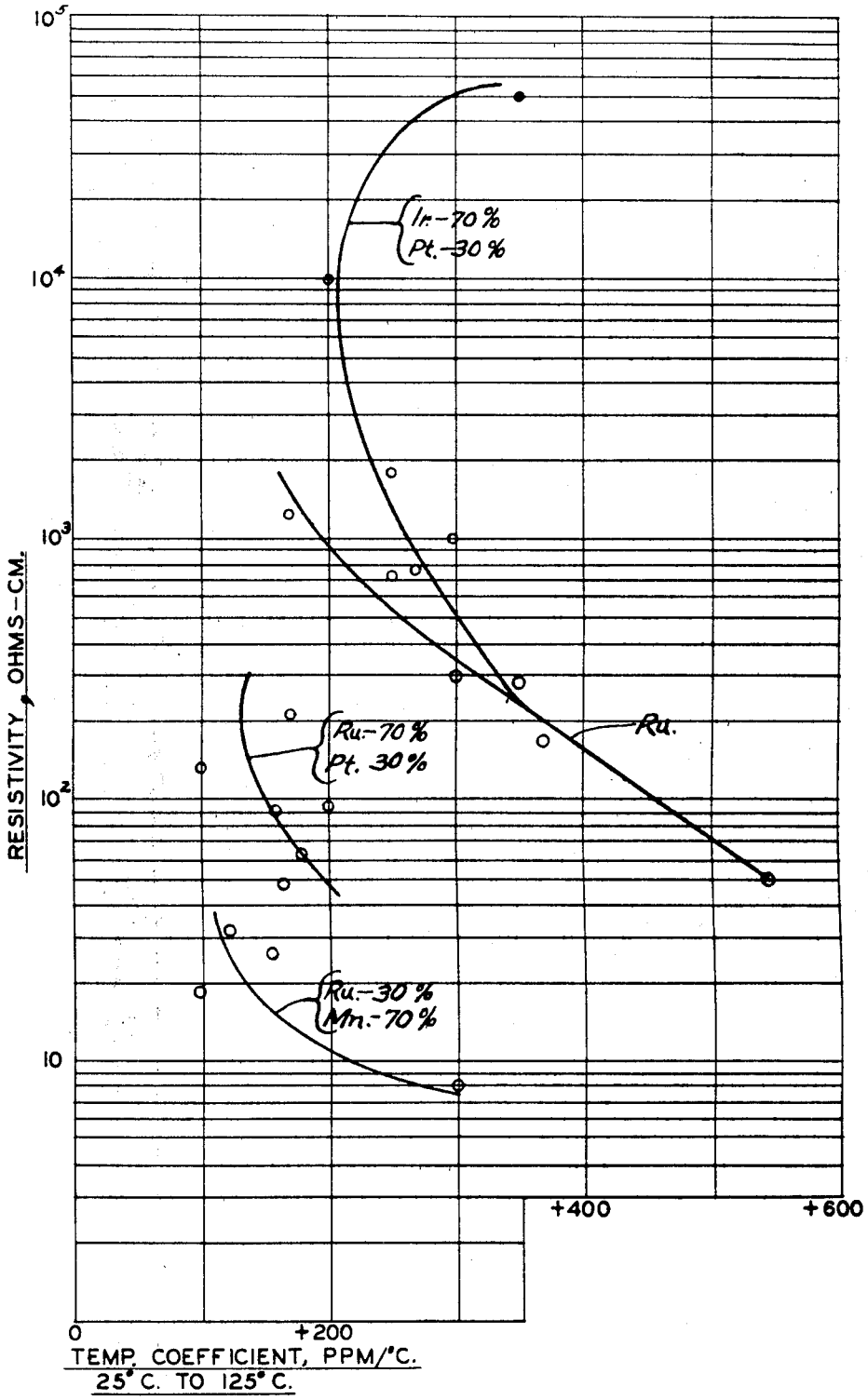
FIG. 11 is a graph illustrating the relationship of temperature coefficient to resistivity for various metals and combination of metals.
Figure 12:
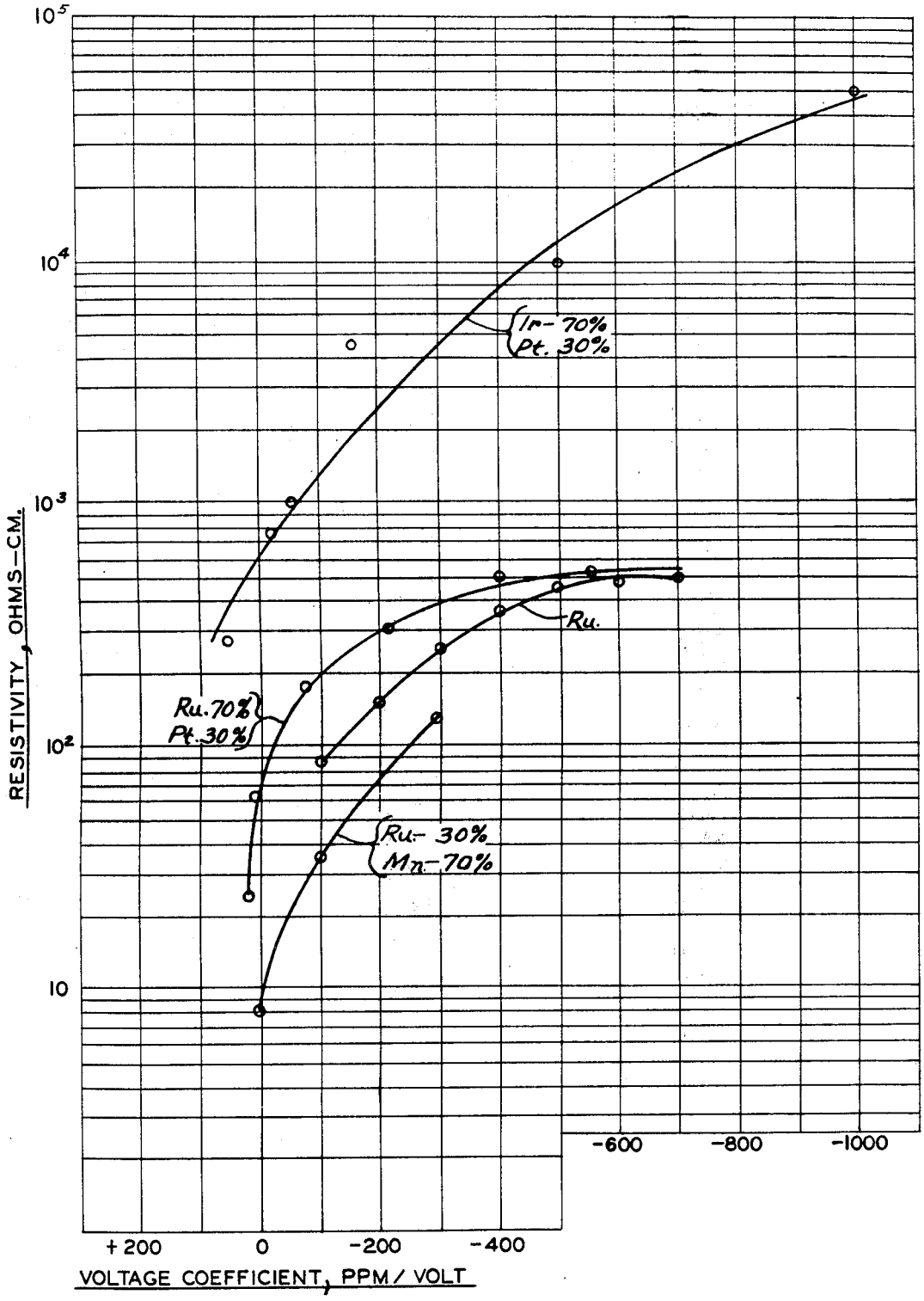
FIG. 12 illustrates how voltage coefficient varies with resistivity for various metals and combinations of metals.

It is observed that in the graphs the amount of metal used does not exceed 2.44 percent by weight of the total mixture whereas the minimum percentage of metal shown is about 0.41 percent. For the specific metals illustrated this range in the percentage of metal has been found to result in the most consistently reproducible resistors. However, satisfactory results have been obtained with the total metal content as high as 5.0 percent and as low as 0.2 percent by weight of the total materials present. Also it is to be observed that either ruthenium or iridium is always present. It has been our experience that unless one of these metals is used, the desired electrical properties cannot be consistently obtained. This may be due in part at least, to the fact that the oxides of these metals possess the tin oxide crystalline structure whereas with the exception of osmium the other noble metals do not. The oxide of osmium is too volatile to be used due to the high firing temperatures required to fuse the glass and, therefore, is used only for certain resistor applications. By x-ray diffraction studies of the resistors, it has been determined that the oxides of these metals are present in the fired resistors. We have not been able to determine what percentage of the metal oxidized, but it is believed that the longer the resistor is held at the firing temperature the more oxidation will occur. This theory appears to be borne out by the fact that the resistance of the products can be increased by subsequent firing. Since the oxides of ruthenium and iridium are more resistive than the metal, it should follow that by further oxidation of these metals the resistance of the product would be increased. This is graphically illustrated in FIG. 10 where the resistivity of a resistor containing 0.415 percent by weight ruthenium was raised from 215 ohm-cm to about 1060 ohm-cm by two minutes additional firing at 800° C. The metals used are all obtained by the reduction of pyrolytically reducible compounds containing them. This feature of the invention will be fully discussed below when the method of manufacturing the resistors is described. The relationship of temperature coefficient and voltage coefficient with resistivity for these specific metals is illustrated in FIGS. 11 and 12.

THE MANUFACTURING PROCESS

Figure 4:
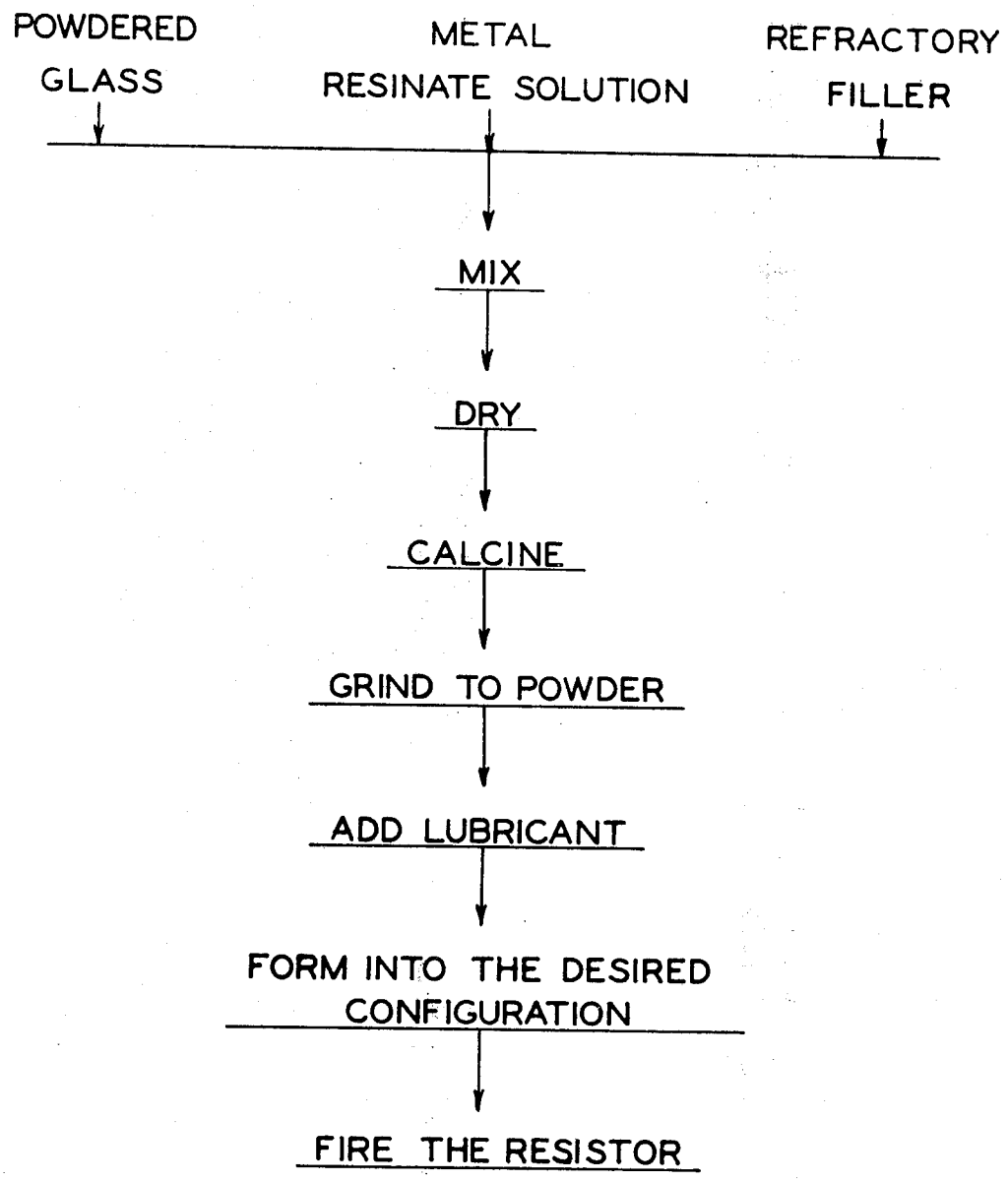
FIG. 4 illustrates schematically the method employed in practicing the invention.

The method of manufacturing the resistors according to this invention is shown diagramatically in FIG. 4. The first step is thoroughly to mix the materials together. At this point the glass and the refractory materials are finely ground powders passable through a 325 mesh screen. The resinate containing the desired metal or metals is dissolved in essential oils and added as a liquid in an amount sufficient to provide the desired metal content. This mixture is dried at about 150° C. to drive off all the volatile solvents and then calcined at about 350° C. for about twenty minutes to decompose pyrolytically the resinates and to burn off the organic residue. During both the drying and calcining step, the mixture is constantly stirred to ensure a homogeneous distribution of the materials.

After the mixture has been calcined, it usually contains some lumps so it is again ground fine enough to pass through a 325 mesh screen. A lubricant such as wax is then added which causes the powdered mixture to granulate into particles of various sizes. Since it is desirable to have a fairly uniform particle size when feeding the mixture into the mold where it is to be pressed into the desired configuration, the granulated mixture is screened to a particle size ranging from 0.1 mm to 0.25 mm. In the mold, the powder is subjected to pressure ranging from 30,000 psi to 90,000 psi which causes the granules to form a pellet having sufficient strength to be removed from the mold and placed in a kiln without crumbling. Instead of pressing the powder into the desired shape, it can be extruded by adding a suitable liquid, such as glycerol, to make a paste with sufficient viscosity to hold its shape after being forced through the die. After forming the resistors, they are placed in a tunnel kiln and fired at about 800° C. At this temperature the glass fuses and bonds to the crystals of metal. It also fills the interstices formed by the refractory material, completely bonding all of the materials together.

Figure 3:
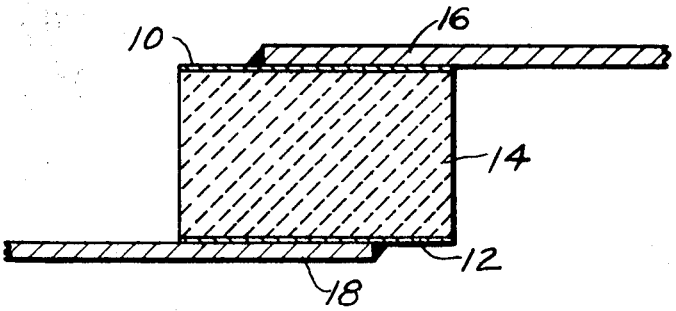
FIG. 3 is a sectional view taken along line III—III of FIG. 2.

The resistor is then terminated. One method of termination employs a conductive paste. This paste is applied to both ends and dried, either by heating in an oven or by infra-red heat lamps. The resistor is then re-fired at about 800° C. to fuse the conductor in the paste to the resistor. An alternate method of terminating the resistor is by placing a metal disc at each end of the resistor when the powder is pressed into shape originally. These discs may also be attached after firing with a conductive paste like that used in the first method. This will produce a resistor like that shown in FIG. 3 where the discs 10 and 12 are shown on each end of the resistor 14. If the resistor is not to be used in a printed circuit arrangement, it can be connected into a circuit by leads 16 and 18. These leads may be attached to the terminations by soldering, welding, or by using a conductive adhesive. The electrical properties of the resistor can now be determined. If the resistance is too high the resistor may be rejected. If the resistance is too low, however, we have found that it can be increased by refiring the resistor at about 800° C. to further oxidize the ruthenium or the iridium. This firing is usually done for only two minutes at a time until the desired resistance is reached.

From the above description it is believed that one skilled in the art can readily understand the invention. The commercial success of this invention is due in large measure to the ability to mass produce these resistors in extremely small sizes with a wide range of resistivities. These resistors also have extremely high structural strength and good stability at elevated temperatures.

What is claimed as new and desired to be secured by Letters Patent of the United States is:

1. The method of manufacturing an electrical resistor comprising:

a. admixing glass particles, finely divided refractory filler oxide, and a pyrolytically decomposable resinate compound containing one of the noble metals,
b. heating the mixture to decompose the metal containing compound,
c. forming the mixture into the desired shape, and
d. firing the mixture at a temperature sufficient to fuse the glass but below the temperature required to soften the refractory filler oxide.

2. The method of manufacturing an electrical resistor comprising:

a. admixing finely divided refractory filler oxide, finely divided glass particles, and a pyrolytically decomposable resinate compound containing one of the metals selected from the group consisting of gold, silver, platinum, palladium, rhodium, iridium, osmium, and ruthenium,
b. heating the mixture to drive off the volatile portion of the resinate compound,
c. calcining the mixture to decompose the resinate compound and burn off any carbonaceous residue,
d. grinding the mixture,
e. adding the lubricant to the mixture,
f. forming the mixture into the desired shape, and
g. firing the mixture at a temperature sufficient to fuse the finely divided glass particles but not the refractory filler oxide.

3. A method of manufacturing an electrical resistor comprising the steps of mixing finely divided glass particles and finely divided refractory filler oxide particles to form a composition, the refractory filler oxide particles having a softening temperature higher than the glass particles, coating the particles with one of the noble metals, forming the composition into individual bodies, firing the bodies at a temperature sufficient to soften the finely divided glass particles but below a temperature sufficient to soften the refractory filler oxide particles thereby causing the glass to flow into the porous structure of the refractory filler oxide particles, and cooling the bodies to solidify the glass and form an electrical resistor.

* * * * *